US011739283B2

(12) United States Patent
Shimizu et al.

(10) Patent No.: US 11,739,283 B2
(45) Date of Patent: *Aug. 29, 2023

(54) LUBRICANT ADDITIVE, LUBRICANT ADDITIVE COMPOSITION, AND LUBRICATING OIL COMPOSITION CONTAINING THE SAME

(71) Applicant: NOF CORPORATION, Tokyo (JP)

(72) Inventors: Yutaro Shimizu, Amagasaki (JP); Hideki Kawamoto, Amagasaki (JP); Kazuhiro Oda, Amagasaki (JP); Seita Ueda, Amagasaki (JP)

(73) Assignee: NOF CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/439,394

(22) PCT Filed: Mar. 10, 2020

(86) PCT No.: PCT/JP2020/010341

§ 371 (c)(1),
(2) Date: Sep. 14, 2021

(87) PCT Pub. No.: WO2020/184568

PCT Pub. Date: Sep. 17, 2020

(65) Prior Publication Data

US 2022/0154096 A1 May 19, 2022

(30) Foreign Application Priority Data

Mar. 14, 2019 (JP) ..... 2019-047822
Feb. 20, 2020 (JP) ..... 2020-027128

(51) Int. Cl.

| | |
|---|---|
| ***C10M 169/04*** | (2006.01) |
| ***C10M 129/72*** | (2006.01) |
| ***C10M 129/76*** | (2006.01) |
| ***C10M 133/10*** | (2006.01) |
| ***C10M 137/10*** | (2006.01) |
| ***C10M 141/10*** | (2006.01) |

(52) U.S. Cl.

CPC ..... *C10M 169/04* (2013.01); *C10M 129/72* (2013.01); *C10M 129/76* (2013.01); *C10M 133/10* (2013.01); *C10M 137/10* (2013.01); *C10M 141/10* (2013.01); *C10M 2203/003* (2013.01); *C10M 2207/127* (2013.01); *C10M 2215/26* (2013.01); *C10M 2223/045* (2013.01)

(58) Field of Classification Search

CPC ..... C10M 2207/28; C10M 2207/289; C10M 2209/084; C10M 2223/045; C10M 141/10; C10M 129/68; C10M 129/72; C10M 129/76; C10M 137/10; C10N 2030/06; C10N 2030/24; C10N 2030/02; C10N 2040/25; C10N 2040/08; C10N 2040/20

See application file for complete search history.

(56) References Cited

U.S. PATENT DOCUMENTS

| | | | | |
|---|---|---|---|---|
| 4,010,007 | A * | 3/1977 | Bollinger | C10L 1/2222 252/392 |
| 10,351,791 | B2 * | 7/2019 | Reid | F02M 25/00 |
| 2010/0093573 | A1 * | 4/2010 | Kocsis | C10M 141/06 508/555 |
| 2020/0277534 | A1 * | 9/2020 | Petts | C10L 10/18 |

FOREIGN PATENT DOCUMENTS

| | | | |
|---|---|---|---|
| JP | H06-200268 | A | 7/1994 |
| JP | 2003073685 | A | 3/2003 |
| JP | 2005002215 | A | 1/2005 |
| JP | 2007131792 | A | 5/2007 |
| JP | 2010528154 | A | 8/2010 |
| JP | 2011140642 | A | 7/2011 |
| JP | 4806198 | B2 | 11/2011 |
| JP | 2015168813 | A | 9/2015 |

* cited by examiner

*Primary Examiner* — Vishal V Vasisth

(57) ABSTRACT

A lubricant additive capable of imparting various functions to a lubricant base oil contains an ester compound (A) represented by formula (1) and an ester compound (B) represented by formula (2). (A):(B) being a mass ratio of the ester compound (A) to the ester compound (B) is 99:1 to 80:20.

4 Claims, No Drawings

LUBRICANT ADDITIVE, LUBRICANT ADDITIVE COMPOSITION, AND LUBRICATING OIL COMPOSITION CONTAINING THE SAME

This application is a 371 of PCT/JP2020/010341, filed Mar. 10, 2020.

FIELD

The present invention relates to a lubricant additive, a lubricant additive composition, and a lubricating oil composition containing the lubricant additive or the lubricant additive composition. More specifically, the present invention relates to an ash-free type multifunctional lubricant additive capable of imparting various functions such as wear resistance, friction reducing properties, demulsibility, and metal corrosion resistance to a lubricant base oil (hereinafter, also simply referred to as "base oil"), the lubricant additive not containing metal components such as zinc, not containing phosphorus and sulfur, and not generating ash components when being used. The present invention also relates to a lubricant additive composition capable of imparting various functions such as load bearing capacity, friction reducing properties, and demulsibility to a base oil, and a lubricating oil composition containing the lubricant additive or the lubricant additive composition.

BACKGROUND

Lubricating oils used in engine oil, hydraulic oil, metal-working oil, and the like are composed of a base oil and an additive having various functions. Among the functions of lubricating oils, wear resistance and load bearing capacity are considered as being particularly important, and zinc dithiophosphate (ZnDTP) is generally used as a typical additive for imparting wear resistance and load bearing capacity to lubricating oils.

However, ZnDTP is a compound containing zinc, phosphorus, and sulfur, and ash components are generated by combustion of metal components such as zinc. For example, when ZnDTP is contained in the engine oil of a diesel vehicle, ash components are generated by driving the engine, and these ash components may promote clogging of a diesel particulate filter (DPF) mounted in the diesel vehicle. Further, if phosphorus or sulfur are contained in the engine oil, there may be a stronger influence on a three-way catalyst used to purify exhaust gases of an automobile. Therefore, an ash-free type wear-resistant agent that does not contain metal components such as zinc, does not contain phosphorus and sulfur, and does not generate ash components is desired. For example, PTL 1 discloses tartrate esters composed of tartaric acid and alcohols as ash-free type wear-resistant agents.

In addition to wear resistance, lubricating oils need to have various performance characteristics such as friction reducing properties, metal corrosion resistance, and demulsibility. Therefore, a plurality of additives are generally used together with a wear-resistant agent. As a combination of an ash-free type wear-resistant agent with another additive, for example, PTL 2 discloses a combination of a boron-containing succinimide and an ash-free friction modifier with improved wear resistance and detergency properties.

However, in some combinations of additives, there may be incompatibility between additives, and when such a combination is used, these additives may hamper each other's performance. Therefore, it is desired to develop a multifunctional additive capable of imparting various functions by use of that one kind of additive and in which the content of phosphorus and sulfur is reduced.

As an ash-free type multifunctional additive, PTL 3 discloses a neutralization product of a condensation reaction mixture for improving metal corrosion resistance and friction reducing properties, which is obtained by reacting a polyhydric alcohol with a carboxylic acid, PTL 4 discloses a mixture of a succinic acid derivative and an amide compound for improving rust prevention and friction reducing properties, and PTL 5 discloses an N-acyl-N-alkoxy aspartate ester for improving corrosion prevention, wear resistance, and demulsibility, for example.

However, even with the additives disclosed in PTLs 1 to 5 mentioned above, only about two or three functions can be imparted to the base oil, which is still insufficient. Therefore, the development of an ash-free type multifunctional additive capable of imparting more functions to the base oil is desired.

On the other hand, if the added amount of ZnDTP is reduced, the load bearing capacity may decrease. Therefore, various studies are conducted to improve the load bearing capacity while reducing the added amount of ZnDTP. For example, PTL 6 discloses a lubricating oil agent containing a combination of a polysulfide extreme pressure agent and ZnDTP, and PTL 7 discloses a lubricating oil composition containing a combination of a phosphonate ester and ZnDTP.

Further, the reduction of the viscosity of lubricating oils proceeds, for the purpose of saving energy. However, if the viscosity is reduced, an oil film formed between metal members is thin, so that the lubrication conditions are harsher and the risk of metal wear increases. Therefore, the lubricating oil needs to have further improved load bearing capacity.

Moreover, in addition to the load bearing capacity, it is necessary that the lubricating oil imparts various performance characteristics such as friction reducing properties and demulsibility to the base oil, and thus, a plurality of additives including the extreme pressure agent are usually combined and added.

However, in some combinations of additives, there may be incompatibility between additives, and when such a combination is used, these additives may hamper each other's performance. In these circumstances, PTL 8 discloses an engine oil composition containing a combination of a glycerol fatty acid partial ester and ZnDTP, for example. However, this engine oil composition does not have sufficient load bearing capacity, and further improvement of friction reducing properties and demulsibility is also desired.

CITATION LIST

Patent Literature

PTL 1: Japanese Unexamined Patent Application Publication (Japanese translation of PCT Application) No. 2010-528154 A PTL 2: Japanese Unexamined Patent Application Publication No. 2003-73685 A PTL 3: Japanese Unexamined Patent Application Publication No. 2015-168813 A PTL 4: Japanese Unexamined Patent Application Publication No. 2011-140642 A PTL 5: Japanese Unexamined Patent Application Publication No. H6-200268 A PTL 6: Japanese Patent No. 4806198 B2

PTL 7: Japanese Unexamined Patent Application Publication No. 2005-2215 A

PTL 8: Japanese Unexamined Patent Application Publication No. 2007-131792 A

SUMMARY

Technical Problem

An object of the present invention is to solve the above-described problems, and more specifically, to provide an ash-free type multifunctional lubricant additive capable of imparting various functions such as wear resistance, friction reducing properties, demulsibility, and metal corrosion resistance to a base oil, the lubricant additive not containing metal components such as zinc, not containing phosphorus and sulfur, and not generating ash components when being used, and an object of the present invention is also to provide a lubricating oil composition containing the lubricant additive.

Furthermore, another object of the present invention is to provide a lubricant additive composition capable of imparting various functions such as load bearing capacity, friction reducing properties, and demulsibility to a base oil, while allowing for a reduction of the added amount of ZnDTP, and to provide a lubricating oil composition containing the lubricant additive composition.

Solution to Problem

As a result of diligent studies in order to achieve the object mentioned above, the present inventors have found that, by adding, to a base oil, a lubricant additive containing ester compounds (A) and (B) represented by formulas (1) and (2), respectively, in a specific quantitative ratio, it is possible to obtain a lubricating oil having excellent functions relating to wear resistance, friction reducing properties, demulsibility, and metal corrosion resistance.

Further, the present inventors have found that, when ZnDTP is added to the base oil in a specific quantitative ratio with respect to the above-mentioned lubricant additive, a lubricating oil having excellent functions relating to load bearing capacity, friction reducing properties, and demulsibility is obtained, which led to the completion of the present invention. The present invention based on these findings is described in (1) to (4) below.

(1) A lubricant additive including an ester compound (A) represented by formula (1) and an ester compound (B) represented by formula (2), in which (A):(B) being a mass ratio of the ester compound (A) and the ester compound (B) is 99:1 to 80:20.

[Chem. 1]

Formula (1)

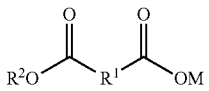

In formula (1), $R^1$ represents a single bond between carbon atoms of carbonyl groups, or a divalent hydrocarbon group having 1 to 4 carbon atoms, and $R^2$ represents a hydrocarbon group having 4 to 22 carbon atoms. M represents a hydrogen atom or organic ammonium.

[Chem. 2]

Formula (2)

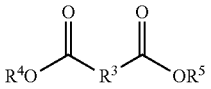

In formula (2), $R^3$ represents a single bond between carbon atoms of carbonyl groups, or a divalent hydrocarbon group having 1 to 4 carbon atoms, and $R^4$ and $R^5$ each independently represent a hydrocarbon group having 4 to 22 carbon atoms.

(2) A lubricant additive composition including the lubricant additive described in (1) above and zinc dithiophosphate (C) represented by formula (3), in which a content of the zinc dithiophosphate (C) is 1 to 1000 parts by mass with respect to a total content of the ester compound (A) and the ester compound (B) being 100 parts by mass.

[Chem. 3]

Formula (3)

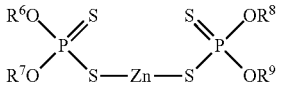

In formula (3), $R^6$ to $R^9$ each independently represent a hydrocarbon group having 1 to 24 carbon atoms.

(3) A lubricating oil composition including 70 to 99.99 mass % of a lubricant base oil and 0.01 to 30 mass % of the lubricant additive according to (1) above.

(4) A lubricating oil composition including 70 to 99.99 mass % of a lubricant base oil and 0.01 to 30 mass % of the lubricant additive composition according to (2) above.

Advantageous Effects of Invention

A lubricant additive according to the present invention is capable of imparting various functions such as wear resistance, friction reducing properties, demulsibility, and metal corrosion resistance to a lubricant base oil. Moreover, the lubricant additive according to the present invention is an ash-free type lubricant additive that does not generate ash components when being used, and thus, does not clog a filter such as a DPF, and further, does not contain phosphorus atoms or sulfur atoms, so that the influence on a three-way catalyst is reduced. Therefore, a lubricating oil composition containing the lubricant additive according to the present invention and a lubricant base oil has excellent functions relating to wear resistance, friction reducing properties, demulsibility, and metal corrosion resistance, even if no ZnDTP is added.

The lubricant additive composition according to the present invention is capable of imparting various functions such as load bearing capacity, friction reducing properties, and demulsibility to a lubricant base oil, while allowing for a reduction of the added amount of ZnDTP. Therefore, the lubricating oil composition containing the lubricant additive composition according to the present invention and a lubricant base oil has excellent functions relating to load bearing capacity, friction reducing properties, and demulsibility, and allows for a reduction of ash generation.

DESCRIPTION

Below, embodiments of a lubricant additive (hereinafter, also simply referred to as "additive") according to the present invention, a lubricant additive composition (hereinafter, also simply referred to as "additive composition") according to the present invention, and a lubricating oil composition containing the additive or the additive composition and a lubricant base oil will be described in detail.

Note that numerical ranges specified by using the word "to" include numerical values on both sides of the word "to" (an upper limit and a lower limit). For example, "2 to 10" means a range of 2 or more and 10 or less.

Further, when a concentration or an amount is specified, any higher concentration or amount can be associated with any lower concentration or amount. For example, when ranges of "2 to 10 mass %" and "preferably 4 to 8 mass %" are mentioned, this expression also includes ranges such as "2 to 4 mass %", "2 to 8 mass %", "4 to 10 mass %", and "8 to 10 mass %".

Lubricant Additive

The additive of the present invention contains an ester compound (A) and an ester compound (B). Each of the ester compounds will be described.

Ester Compound (A)

The ester compound (A) is a compound represented by formula (1) below, and one type of the ester compound (A) can be used alone or two or more types of the ester compound (A) can be used in combination.

[Chem. 1]

Formula (1)

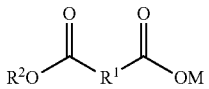

In formula (1), $R^1$ represents a single bond between carbon atoms of carbonyl groups, or a divalent hydrocarbon group having 1 to 4 carbon atoms. The divalent hydrocarbon group having 1 to 4 carbon atoms is a functional group consisting of a carbon atom and a hydrogen atom, is one type selected from an alkylene group and an alkenylene group, and may be linear or branched. When the hydrocarbon group has 5 or more carbon atoms, the chain length is long, so that wear resistance, friction reducing properties, demulsibility, metal corrosion resistance, and load bearing capacity may not be sufficiently obtained.

$R^1$ is preferably an alkylene group or an alkenylene group having 2 carbon atoms, specific examples thereof include an ethylene group and an ethenylene group, and the ethylene group is more preferable.

In formula (1), $R^2$ represents a hydrocarbon group having 4 to 22 carbon atoms. The hydrocarbon group having 4 to 22 carbon atoms is a saturated or unsaturated hydrocarbon group consisting of carbon atoms and hydrogen atoms, and may be linear or branched. Examples of the hydrocarbon group having 4 to 22 carbon atoms include an alkyl group, an alkenyl group, a cycloalkyl group, an aryl group, and an aralkyl group. When the hydrocarbon group has 3 or less carbon atoms or 23 or more carbon atoms, wear resistance, demulsibility, metal corrosion resistance, and load bearing capacity may not be sufficiently obtained.

$R^2$ is preferably an alkyl group or an alkenyl group having 4 to 22 carbon atoms, more preferably a branched alkyl group having 8 to 18 carbon atoms or an alkenyl group having 16 to 22 carbon atoms. Examples of the branched alkyl group having 8 to 18 carbon atoms include a 2-ethylhexyl group, a 3,5,5-trimethylhexyl group, an isotridecyl group, an isostearyl group, and a 2-octyldecyl group, a branched alkyl group having 8 or 9 carbon atoms is more preferable, and a 2-ethylhexyl group is particularly preferable. Furthermore, examples of the alkenyl group having 16 to 22 carbon atoms include a hexadecenyl group, an octadecenyl group, an eicosenyl group, and a docosenyl group, an alkenyl group having 16 to 18 carbon atoms is preferable, an oleyl group and a linoleyl group are more preferable, and an oleyl group is particularly preferable. Among these, an oleyl group is most preferable as $R^2$.

In formula (1), M represents a hydrogen atom or organic ammonium. M is preferably organic ammonium. Examples of the organic ammonium include primary, secondary, tertiary, and quaternary ammonium cations in which a saturated or unsaturated hydrocarbon group having 1 to 24 carbon atoms is bonded to a nitrogen atom, and these ammonium cations may be linear, branched, or cyclic. Further, hydrocarbon groups in the secondary, tertiary, and quaternary ammonium cations may be the same, or at least one of the hydrocarbon groups may be different. Examples of the organic ammonium include ethylammonium, diethylammonium, dioctylammonium, triethylammonium, trioctylammonium, dimethyllaurylammonium, and dimethylstearylammonium. From the viewpoint of wear resistance, friction reducing properties, and load bearing capacity, the total number of carbon atoms of the hydrocarbon groups in the organic ammonium is preferably 3 to 24, more preferably 10 to 18, and even more preferably 12 to 16.

A method for producing the ester compound (A) represented by formula (1) mentioned above is not particularly limited, and examples thereof include a method in which an acid and an alcohol are subjected to an esterification reaction at 60 to 180° C., for example. From the viewpoint of reactivity, it is preferable to use an acid anhydride in the esterification reaction for producing the ester compound (A). Further, it is preferable to use an equal amount of alcohol in molar ratio with respect to the acid anhydride.

A method for producing the ester compound (A) in which M in formula (1) is organic ammonium is also not particularly limited. For example, the ester compound (A) in which M in formula (1) is organic ammonium can be produced by subjecting the ester produced by the above-described production method and an amine compound such as a tertiary amine to a neutralization reaction at 20 to 60° C., for example. When neutralizing an ester compound in which M is a hydrogen atom with an amine compound to produce the ester compound in which M is organic ammonium, it is preferable, from the viewpoint of metal corrosion resistance, wear resistance, and load bearing capacity, that a molar ratio of the ester compound in which M is a hydrogen atom to the amine compound is in a range from 60:40 to 40:60, more preferably in a range from 55:45 to 45:55, and even more preferably in a range from 52:48 to 48:52.

Ester Compound (B)

The ester compound (B) is a compound represented by formula (2) below, and one type of the ester compound (B) can be used alone or two or more types of the ester compound (B) can be used in combination.

[Chem. 2]

Formula (2)

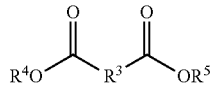

In formula (2), $R^3$ represents a single bond between carbon atoms of carbonyl groups, or a divalent hydrocarbon group having 1 to 4 carbon atoms. The divalent hydrocarbon group having 1 to 4 carbon atoms is a functional group consisting of a carbon atom and a hydrogen atom, is one type selected from an alkylene group and an alkenylene group, and may be linear or branched. When the hydrocarbon group has 5 or more carbon atoms, the chain length is long, so that wear resistance, metal corrosion resistance, and load bearing capacity may not be sufficiently obtained.

$R^3$ is preferably an alkylene group or an alkenylene group having 2 carbon atoms, specific examples thereof include an ethylene group and an ethenylene group, and the ethylene group is more preferable.

In formula (2), $R^4$ and $R^5$ each independently represent a hydrocarbon group having 4 to 22 carbon atoms, and $R^4$ and $R^5$ may be the same or may be different from each other. The hydrocarbon group having 4 to 22 carbon atoms is a saturated or unsaturated hydrocarbon group consisting of carbon atoms and hydrogen atoms, and may be linear or branched. Examples of the hydrocarbon group having 4 to 22 carbon atoms include an alkyl group, an alkenyl group, a cycloalkyl group, an aryl group, and an aralkyl group. When the hydrocarbon group has 3 or less carbon atoms or 23 or more carbon atoms, wear resistance, demulsibility, metal corrosion resistance, and load bearing capacity may not be sufficiently obtained.

$R^4$ and $R^5$ are each preferably an alkyl group or an alkenyl group having 4 to 22 carbon atoms, more preferably a branched alkyl group having 8 to 18 carbon atoms or an alkenyl group having 16 to 22 carbon atoms. Examples of the branched alkyl group having 8 to 18 carbon atoms include a 2-ethylhexyl group, a 3,5,5-trimethylhexyl group, an isotridecyl group, an isostearyl group, and a 2-octyldecyl group, a branched alkyl group having 8 or 9 carbon atoms is preferable, and a 2-ethylhexyl group is particularly preferable. Furthermore, examples of the alkenyl group having 16 to 22 carbon atoms include a hexadecenyl group, an octadecenyl group, an eicosenyl group, and a docosenyl group, an alkenyl group having 16 to 18 carbon atoms is preferable, an oleyl group and a linoleyl group are more preferable, and an oleyl group is particularly preferable. Among these, an oleyl group is most preferable as $R^4$ and $R^5$.

A method for producing the ester compound (B) represented by formula (2) mentioned above is not particularly limited, and examples thereof include a method in which an acid and an alcohol are subjected to an esterification reaction at 150 to 240° C., for example. In the esterification reaction for producing the ester compound (B), it is preferable to use an alcohol in an amount that is two or more times the amount of the acid, in molar ratio.

The additive according to the present invention is a mixture of the ester compound (A) represented by formula (1) and the ester compound (B) represented by formula (2).

(A):(B) being a mixing ratio of the ester compound (A) and the ester compound (B) is 99:1 to 80:20, preferably 98:2 to 90:10, and more preferably 98:2 to 95:5, as expressed as mass ratios. If the amount of the ester compound (B) is too small relative to the ester compound (A), sufficient demulsibility may not be obtained. Further, when the amount of the ester compound (B) of formula (2) is too large relative to the ester compound (A), wear resistance, friction reducing properties, and load bearing capacity may not be sufficiently obtained.

Lubricant Additive Composition

The additive composition of the present invention contains the above-described ester compound (A), the above-described ester compound (B), and zinc dithiophosphate (C) described below.

Zinc Dithiophosphate (C)

Zinc dithiophosphate (C) is a compound represented by formula (3) below, and one type of zinc dithiophosphate (C) can be used alone or two or more types of zinc dithiophosphate (C) can be used in combination.

[Chem. 3]

Formula (3)

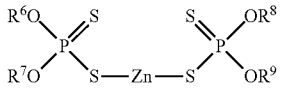

In formula (3), $R^6$ to $R^9$ each independently represent a hydrocarbon group having 1 to 24 carbon atoms, and $R^6$ to $R^9$ may be the same or may be different from each other. The hydrocarbon group having 1 to 24 carbon atoms is a saturated or unsaturated hydrocarbon group consisting of a carbon atom and a hydrogen atom, and may be linear or branched. Examples of the hydrocarbon group having 1 to 24 carbon atoms include an alkyl group, an alkenyl group, a cycloalkyl group, an aryl group, and an aralkyl group.

$R^6$ to $R^9$ are preferably linear or branched alkyl groups having 3 to 18 carbon atoms, more preferably, linear or branched alkyl groups having 3 to 12 carbon atoms, and even more preferably, branched alkyl groups having 3 to 12 carbon atoms.

Examples of the linear alkyl group having 3 to 12 carbon atoms include a propyl group, a butyl group, a pentyl group, a hexyl group, an octyl group, and a decyl group, and the butyl group and the pentyl group are more preferable. Further, zinc dithiophosphate (C) includes preferably two or more types of the above-mentioned linear alkyl groups as $R^6$ to $R^9$, and it is particularly preferable that zinc dithiophosphate (C) includes both a linear butyl group and a linear pentyl group.

Examples of the branched alkyl group having 3 to 12 carbon atoms include an isopropyl group, an isobutyl group, an isopentyl group, a neopentyl group, an isohexyl group, a 2-ethylhexyl group, a 3,5,5-trimethylhexyl group, and an isodecyl group, and the isohexyl group, the 2-ethylhexyl group, and the 3,5,5-trimethylhexyl group are more preferable, and the isohexyl group is even more preferable.

Typical examples of ZnDTP include LUBRIZOL 677A and LUBRIZOL 1371, which are commercially available from Lubrizol Corporation.

The mixing ratio of the ester compounds (A) and (B) with zinc dithiophosphate (C) is such that, with respect to the total content of the ester compound (A) and the ester compound (B) being 100 parts by mass, the content of zinc dithiophosphate (C) is 1 to 1000 parts by mass, preferably 10 to 500 parts by mass, more preferably 20 to 300 parts by mass, and even more preferably 50 to 200 parts by mass. If the content of zinc dithiophosphate (C) is too low, sufficient load bearing capacity may not be obtained. Further, if the content of zinc dithiophosphate (C) is too large, sufficient friction reducing properties may not be obtained.

The additive composition according to the present invention contains at least the ester compound (A), the ester compound (B), and zinc dithiophosphate (C), and may further contain other additives such as extreme pressure agents, wear-resistant agents, and antioxidants, as long as the effects of the additive composition according to the present invention are not impaired.

Lubricating Oil Composition

The lubricating oil composition according to the present invention contains the additive according to the present invention or the additive composition according to the present invention, and a lubricant base oil. The lubricating oil composition containing the additive according to the present invention and the lubricant base oil is referred to as "lubricating oil composition (1)", and the lubricating oil composition containing the additive composition according to the present invention and the lubricant base oil is referred to as "lubricating oil composition (2)".

Various lubricant base oils can be employed as the lubricant base oil in the present invention. Examples of the lubricant base oil include conventionally used lubricant base oils such as mineral oils, highly refined mineral oils, animal and vegetable oils and fats, synthetic esters, poly-α-olefins, and gas-to-liquid (GTL) oils.

Concerning each of the contents of the lubricant base oil and the additive in the lubricating oil composition (1) of the present invention, the content of the lubrication base oil is 70 to 99.99 mass % and the content of the additive is 0.01 to 30 mass %. The content of the lubrication base oil is preferably 80 to 99.95 mass %, and more preferably 90 to 99.9 mass %. The content of the additive is preferably 0.05 to 20 mass %, and more preferably 0.1 to 10 mass %. If the content of the additive in the lubricating oil composition (1) of the present invention is too small, wear resistance, friction reducing properties, demulsibility, and metal corrosion resistance may not be sufficiently obtained. Further, if the content of the additive is too large, wear resistance, friction reducing properties, demulsibility, and metal corrosion resistance corresponding to the added amount may not be obtained.

Note that the total of the contents of the lubricant base oil and the additive is 100 mass %.

Concerning each of the contents of the lubricant base oil and the additive composition in the lubricating oil composition (2) of the present invention, the content of the lubrication base oil is 70 to 99.99 mass % and the content of the additive composition is 0.01 to 30 mass %. The content of the lubrication base oil is preferably 80 to 99.95 mass %, and more preferably 90 to 99.9 mass %. The content of the additive composition is preferably 0.05 to 20 mass %, and more preferably 0.1 to 10 mass %. If the content of the additive composition in the lubricating oil composition (2) of the present invention is too small, load bearing capacity, friction reducing properties, and demulsibility may not be sufficiently obtained. Further, if the content of the additive composition is too large, load bearing capacity, friction reducing properties, and demulsibility corresponding to the added amount may not be obtained.

Note that the total of the contents of the lubricant base oil and the additive composition is 100 mass %.

If required, additives such as detergent dispersants, viscosity index improvers, anti-rust agents, corrosion inhibitors, pour point depressants, and metal deactivators may also be added to the lubricating oil compositions (1) and (2) according to the present invention.

The order in which blending, mixing, and addition of the additives are performed is not particularly limited, and various methods can be adopted. For example, in the case of preparing the lubricating oil composition (2) of the present invention, a method may be employed in which the ester compound (A), the ester compound (B), zinc dithiophosphate (C), and optional various types of additives are added to the lubricant base oil and mixed by heating, or a method may be employed in which a solution having a high concentration of each of the additives is prepared in advance and this solution is mixed with the lubricant base oil.

EXAMPLES

Below, the present invention will be described in more detail with reference to examples and comparative examples.

A production example of the ester compound (A) represented by formula (1) is described in Synthesis Example 1 below, and a production example of the ester compound (B) represented by formula (2) is described in Synthesis Example 2 below. Further, in Formulation Example 1 below, a production example of an additive 1 composed of the ester compound (A) represented by formula (1) and the ester compound (B) represented by formula (2) is described.

Synthesis Example 1, Compound (A-1) of Formula (1)

A thermometer and a nitrogen introduction tube were inserted into a 1 L four-neck flask, and oleyl alcohol (250 g, 0.93 mol) and succinic anhydride (93.2 g, 0.93 mol) were introduced into the flask and allowed to react at 120° C. using a mantle heater. The reaction was terminated when the decrease in acid value per hour was 0.5 mg KOH/g or less, and the mixture was cooled to room temperature. Next, 200.6 g (0.93 mol) of dimethyllaurylamine was added, and the mixture was stirred and mixed at 25° C. for 1 hour to obtain 543.8 g (0.93 mol) of compound (A-1) of formula (1).

Compounds (A-2), (A-3), (A-4), and (A-5) of formula (1) shown in Table 1 were synthesized by using other compounds instead of oleyl alcohol, succinic anhydride, and dimethyllaurylamine in Synthesis Example 1, as appropriate, and performing operation according to Synthesis Example 1.

TABLE 1

| Compound | $R^1$ | $R^2$ | M |
|---|---|---|---|
| A-1 | Ethylene | Oleyl | Dimethyllaurylammonium |
| A-2 | Ethenylene | 2-ethylhexyl | Dimethyllaurylammonium |
| A-3 | Ethylene | Isotridecyl | Dimethyllaurylammonium |
| A-4 | Ethylene | Oleyl | Hydrogen atom |
| A-5 | Ethylene | Ethyl | Dimethyllaurylammonium |

Synthesis Example 2, Compound (B-1) of Formula (2)

A thermometer and a nitrogen introduction tube were inserted into a 500 ml four-neck flask, oleyl alcohol (300 g, 1.12 mol) and succinic anhydride (55.9 g, 0.56 mol) were introduced into the flask and allowed to react at 240° C. using a mantle heater. The reaction was terminated when the decrease in acid value per hour was 0.5 mg KOH/g or less, and 345.9 g (0.56 mol) of compound (B-1) of formula (2) was obtained.

Compounds (B-2), (B-3), and (B-4) of formula (2) shown in Table 2 were synthesized by using other compounds instead of oleyl alcohol and succinic anhydride in Synthesis Example 2, as appropriate, and performing operation according to Synthesis Example 2.

TABLE 2

| Compound | $R^3$ | $R^4$ | $R^5$ |
|---|---|---|---|
| B-1 | Ethylene | Oleyl | Oleyl |
| B-2 | Ethenylene | 2-ethylhexyl | 2-ethylhexyl |
| B-3 | Ethylene | Isotridecyl | Isotridecyl |
| B-4 | Ethylene | Ethyl | Ethyl |

Formulation Example 1, Additive 1

A thermometer and a nitrogen introduction tube were inserted into a 1 L four-neck flask, and compound (A-1) (500 g, 0.85 mol) synthesized in Synthesis Example 1 and compound (B-1) (10.3 g, 0.017 mol) synthesized in Synthesis Example 2 were stirred and mixed at 25° C. for 1 hour to obtain 510.3 g of additive 1.

Additives 2 to 8 shown in Table 3 were obtained by using a blending ratio different from the blending ratio of compound (A-1) of formula (1) and compound (B-1) of formula (2) used in Formulation Example 1, as appropriate, and performing operation according to Formulation Example 1.

TABLE 3

| | Blending ratio (mass ratio) | | | | | | | | |
|---|---|---|---|---|---|---|---|---|---|
| | Ester compound (A) of formula (1) | | | | | Ester compound (B) of formula (2) | | | |
| Additive | A-1 | A-2 | A-3 | A-4 | A-5 | B-1 | B-2 | B-3 | B-4 |
| 1 | 98 | — | — | — | — | 2 | — | — | — |
| 2 | — | 98 | — | — | — | — | 2 | — | — |
| 3 | 92 | — | — | — | — | 8 | — | — | — |
| 4 | — | — | — | 98 | — | 2 | — | — | — |
| 5 | — | — | 98 | — | — | — | — | 2 | — |
| 6 | 100 | — | — | — | — | — | — | — | — |
| 7 | 75 | — | — | — | — | 25 | — | — | — |
| 8 | — | — | — | — | 98 | — | — | — | 2 |

Formulation Example 2, Preparation of Lubricating Oil Composition (1)

0.5 mass % of each of the additives 1 to 8 mentioned above was blended to the lubricant base oil (poly-α-olefin, kinematic viscosity (40° C.): about 50 $mm^2/s$) to obtain lubricating oil compositions (1-1) to (1-8) of Examples (1-1) to (1-5) and Comparative Examples (1-1) to (1-3). The obtained lubricating oil compositions (test oils) were subjected to the evaluation tests described below. The evaluation results of Examples (1-1) to (1-5) are shown in Table 4 below, and the evaluation results of Comparative Examples (1-1) to (1-3) are shown in Table 5 below.

Wear Resistance Test

The wear resistance was evaluated by using an SRV test instrument (Schwingungs Reihungundund Verschleiss test instrument type 4, manufactured by OPTIMOL). The SRV test was performed with a ball/disc, and each test piece was made of SUJ-2. The test conditions were a test temperature of 150° C., a load of 100 N, an amplitude of 1 mm, and a frequency of 50 Hz, and the wear scar diameter was measured after a test time of 25 minutes had elapsed.

The evaluation results were assessed as good: wear scar diameter of less than 350 μm, acceptable: 350 μm or more and less than 400 μm, and unacceptable: 400 μm or more.

Test of Friction Reducing Properties

The friction coefficient was evaluated by using a multifunctional friction and wear tester (UMT-TriboLab, manufactured by BRUKER). The tribology test was performed with a cylinder/disc, and each test piece was made of SUJ-2. The test conditions were a test temperature of 25° C., a load of 20 N, a rotation speed of 1000 rpm, and a measurement time of 30 seconds, the test was carried out 10 times, and the average friction coefficient was calculated.

The evaluation results were assessed as good: average friction coefficient of less than 0.035, acceptable: 0.035 or more and less than 0.040, and unacceptable: 0.040 or more.

Demulsibility Test

The demulsibility was evaluated. The evaluation was performed based on JIS K 2520 and the separation time of oil and water was evaluated. The evaluation results were assessed as good: separation time of less than 15 minutes or unacceptable: 15 minutes or more.

Table 4 shows a relationship between the symbols in formula (2) and the compounds.

Metal Corrosion Resistance Test

The copper corrosion resistance was evaluated as the metal corrosion resistance. A copper wire cut to a length of 4 cm was polished with a P150 polishing cloth. 2 ml of test oil was placed into a 5 ml screw cap tube, the copper wire was immersed therein, and the tube was heated at 100° C. for 3 hours. The state of the surface of the copper wire before and after the test was compared to evaluate whether corrosion had occurred.

The evaluation results were assessed as good: no corrosion occurred and unacceptable: corrosion occurred.

TABLE 4

| | Example | | | | |
|---|---|---|---|---|---|
| | 1-1 | 1-2 | 1-3 | 1-4 | 1-5 |
| Additive | 1 | 2 | 3 | 4 | 5 |
| Lubricating oil composition (1) | 1-1 | 1-2 | 1-3 | 1-4 | 1-5 |

TABLE 4-continued

| | | Example | | | | |
|---|---|---|---|---|---|---|
| | | 1-1 | 1-2 | 1-3 | 1-4 | 1-5 |
| Wear resistance | Wear scar diameter (μm) | Good (310) | Good (330) | Acceptable (370) | Acceptable (370) | Acceptable (390) |
| Friction reducing properties | Friction coefficient | Good (0.030) | Good (0.032) | Good (0.034) | Acceptable (0.039) | Acceptable (0.039) |
| Demulsibility | | Good | Good | Good | Good | Good |
| Metal corrosion resistance | | Good | Good | Good | Good | Good |

TABLE 5

| | | Comparative Example | | |
|---|---|---|---|---|
| | | 1-1 | 1-2 | 1-3 |
| | | Additive | | |
| | | 6 | 7 | 8 |
| | | Lubricating oil composition (1) | | |
| | | 1-6 | 1-7 | 1-8 |
| Wear resistance | Wear scar diameter (μm) | Good (330) | Unacceptable (550) | Unacceptable (570) |
| Friction reducing properties | Friction coefficient | Good (0.033) | Unacceptable (0.050) | Unacceptable (0.060) |
| Demulsibility | | Unacceptable | Good | Good |
| Metal corrosion resistance | | Good | Good | Unacceptable |

As can be clearly understood from the results shown in Table 4, the additives 1 to 5 according to the present invention are capable of imparting excellent wear resistance, friction reducing properties, demulsibility, and metal corrosion resistance to a lubricant base oil. Further, the additives 1 to 5 do not contain metal components such as zinc, and thus, the lubricating oil compositions (1-1) to (1-5) of Examples (1-1) to (1-5) containing these additives 1 to 5 do not generate ash components when being used, so that filters such as DPF are less likely to be clogged. Further, the additives 1 to 5 do not contain phosphorus atoms or sulfur atoms, so that the influence on a three-way catalyst from using the lubricating oil compositions (1-1) to (1-5) of Examples (1-1) to (1-5) is reduced.

Next, an example of preparing an additive composition containing the compounds (A-1) and (A-4) of formula (1) shown in Table 1, compound (B-1) of formula (2) shown in Table 2, and zinc dithiophosphate (C) described below is described in Formulation Example 3 below. Further, an example of preparing the lubricating oil composition (2) containing the additive composition prepared in Formulation Example 3 is described in Formulation Example 4 below.

Zinc Dithiophosphate: Compounds (C-1) and (C-2) of Formula (3)

LUBRIZOL 677A (alkyl group: branched hexyl group) and LUBRIZOL 1395 (alkyl groups: linear butyl group and linear pentyl group) manufactured by Lubrizol Corp. were used as zinc dithiophosphate. Compound (C-1) is LUBRIZOL 677A and compound (C-2) is LUBRIZOL 1395.

Table 6 shows a relationship between the symbols in formula (3) and the compounds.

TABLE 6

| Compound | $R^6$ | $R^7$ | $R^8$ | $R^9$ |
|---|---|---|---|---|
| C-1 | Branched hexyl group | | | |
| C-2 | Linear butyl group and linear pentyl group | | | |

Formulation Example 3, Preparation of Additive Compositions

A thermometer and a nitrogen introduction tube were inserted into a four-neck flask (300 mL to 1 L), and the additives shown in Table 7 were stirred and mixed at 25° C. for 1 hour to obtain additive compositions 1 to 8.

TABLE 7

| Additive composition | Additive blending amount (g) | | | | | Blending ratio (mass ratio) | |
|---|---|---|---|---|---|---|---|
| | Compound (A) | | Compound (B) | Compound (C) | | | |
| | A-1 | A-4 | B-1 | C-1 | C-2 | A:B | (A + B):C |
| 1 | 98 | — | 2 | 100 | — | 98:2 | 100:100 |
| 2 | 98 | — | 2 | 25 | — | 98:2 | 100:25 |
| 3 | 98 | — | 2 | 400 | — | 98:2 | 100:400 |
| 4 | 98 | — | 2 | — | 100 | 98:2 | 100:100 |
| 5 | — | 98 | 2 | 100 | — | 98:2 | 100:100 |
| 6 | 100 | — | — | 100 | — | 100:0 | 100:100 |
| 7 | 75 | — | 25 | 100 | — | 75:25 | 100:100 |
| 8 | — | — | — | 100 | — | — | 0:100 |

Formulation Example 4, Preparation of Lubricating Oil Composition (2)

The additive compositions 1 to 8 of Table 7 were blended with the lubricant base oil (poly-α-olefin, kinematic viscosity (40° C.): about 50 $mm^2/s$) to obtain lubricating oil compositions (2-1) to (2-9) shown in Table 8.

TABLE 8

| Lubricating oil composition (2) | Base oil (PAO) | Additive composition 1 | 2 | 3 | 4 | 5 | 6 | 7 | 8 |
|---|---|---|---|---|---|---|---|---|---|
| | | Blending amount (wt %) | | | | | | | |
| 2-1 | 99.5 | 0.5 | — | — | — | — | — | — | — |
| 2-2 | | — | 0.5 | — | — | — | — | — | — |
| 2-3 | | — | — | 0.5 | — | — | — | — | — |
| 2-4 | | — | — | — | 0.5 | — | — | — | — |
| 2-5 | | — | — | — | — | 0.5 | — | — | — |
| 2-6 | | — | — | — | — | — | 0.5 | — | — |
| 2-7 | | — | — | — | — | — | — | 0.5 | |
| 2-8 | | — | — | — | — | — | — | — | 0.5 |
| 2-9 | 99 | — | — | — | — | — | — | — | 1 |

The obtained lubricating oil compositions (test oils) were subjected to the evaluation tests described below. The evaluation results are shown in Tables 9 and 10.

Load Bearing Capacity Test

The seizure load was evaluated with a Shell four-ball tester. The test piece was made of SUJ-2. The test conditions were a test temperature of 25° C., a rotation speed of 1800 rpm, and a test time of 10 seconds, and loads of 50 kg, 63 kg, 80 kg, 100 kg, 126 kg, 160 kg, and 200 kg were applied in this order. In the test, a load at which phenomena such as a sudden increase in friction torque and generation of abnormal noise occurred, and seizure marks were generated on the abrasion surface was defined as the seizure load.

The evaluation results were assessed as good: seizure load of 160 kg or more, acceptable: 126 kg or more and less than 160 kg, and unacceptable: less than 126 kg.

Test of Friction Reducing Properties

The friction coefficient was evaluated by using an SRV test instrument (Schwingungs Reihungundund Verschleiss test instrument type 4, manufactured by OPTIMOL). The SRV test was performed with a cylinder/disc, and each test piece was made of SUJ-2. The test conditions were a test temperature of 100° C., a load of 200 N, an amplitude of 1 mm, and a frequency of 300 Hz, and the friction coefficient was measured after a test time of 60 minutes had elapsed.

The evaluation results were assessed as good: friction coefficient of less than 0.18, acceptable: 0.18 or more and less than 0.2, and unacceptable: 0.2 or more.

Demulsibility Test

The demulsibility was evaluated. The evaluation was performed based on JIS K 2520 and the separation time of oil and water was evaluated. The evaluation results were assessed as good: separation time of less than 10 minutes, acceptable: 10 minutes or more and less than 15 minutes, and unacceptable: 15 minutes or more.

TABLE 9

| | | Example 2-1 | 2-2 | 2-3 | 2-4 | 2-5 |
|---|---|---|---|---|---|---|
| Lubricating oil composition (2) | | 2-1 | 2-2 | 2-3 | 2-4 | 2-5 |
| Load bearing capacity | Seizure load (kg) | Good (200) | Good (160) | Good (160) | Acceptable (126) | Acceptable (126) |
| Friction reducing properties | Friction coefficient (μ) | Good (0.166) | Good (0.167) | Acceptable (0.181) | Good (0.167) | Acceptable (0.190) |
| Demulsibility | Separation time (minutes) | Good (5 minutes) | Good (5 minutes) | Good (5 minutes) | Good (5 minutes) | Acceptable (10 minutes) |

TABLE 10

| | | Comparative Example 2-1 | 2-2 | 2-3 | 2-4 |
|---|---|---|---|---|---|
| | | Lubricating oil composition (2) | | | |
| | | 2-6 | 2-7 | 2-8 | 2-9 |
| Load bearing capacity | Seizure load (kg) | Good (160) | Unacceptable (63) | Unacceptable (100) | Acceptable (126) |
| Friction reducing properties | Friction coefficient (μ) | Good (0.166) | Unacceptable (0.221) | Unacceptable (0.233) | Unacceptable (0.252) |
| Demulsibility | Separation time (minutes) | Unacceptable (30 minutes) | Good (5 minutes) | Good (5 minutes) | Good (5 minutes) |

As can be clearly understood from the results shown in Table 9, the lubricating oil compositions (2-1) to (2-5) of Examples (2-1) to (2-5) using the additive compositions 1 to 5 according to the present invention have excellent load bearing capacity, friction reducing properties, and demulsibility. That is, the additive compositions 1 to 5 are capable of imparting excellent load bearing capacity, friction reducing properties, and demulsibility to a lubricant base oil (PAO). Further, it is possible to reduce the blending amount of zinc dithiophosphate (C) with respect to the lubricant base oil (PAO), so that the generation of ash components can be reduced.

On the other hand, as shown in Table 10, in Comparative Example (2-1) using the additive composition 6 not containing the ester compound (B), sufficient demulsibility was not obtained. Further, in Comparative Example (2-2) using the additive composition 7 having a high content ratio of the ester compound (B), load bearing capacity and friction reducing properties were not sufficiently obtained. Moreover, in Comparative Example (2-3) using the additive composition 8 composed only of zinc dithiophosphate (C), load bearing capacity and friction reducing properties were not sufficiently obtained, and also in Comparative Example (2-4) in which the added amount of the additive composition 8 was larger than that in Comparative Example (2-3), sufficient friction reducing properties were not obtained.

Related Applications

The present application claims priority on the basis of Japanese Patent Application filed on Mar. 14, 2019 (Japanese Patent Application No. 2019-047822) and Japanese Patent Application filed on Feb. 20, 2020 (Japanese Patent Application No. 2020-027128), the entire contents of which are incorporated herein by reference.

What is claimed is:

1. A lubricant additive, comprising:

an ester compound (A) represented by formula (1),

Formula (1)

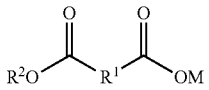

wherein $R^1$ represents an alkylene group or an alkenylene group having 2 carbon atoms, $R^2$ represents an alkyl group or an alkenyl group having 4 to 22 carbon atoms, and M represents a hydrogen atom or tertiary ammonium cations in which a saturated or unsaturated hydrocarbon group having 1 to 24 carbon atoms is bonded to a nitrogen atom; and an ester compound (B) represented by formula (2), Formula (2)

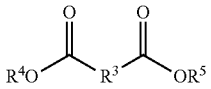

wherein $R^3$ represents an alkylene group or an alkenylene group having 2 carbon atoms, and $R^4$ and $R^5$ each independently represent an alkyl group or an alkenyl group having 4 to 22 carbon atoms, wherein (A):(B) being a mass ratio of the ester compound (A) and the ester compound (B) is 99:1 to 80:20.

2. A lubricant additive composition, comprising:

the lubricant additive according to claim 1; and zinc dithiophosphate (C) represented by formula (3), Formula (3)

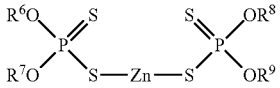

wherein $R^6$ to $R^9$ each independently represent a hydrocarbon group having 1 to 24 carbon atoms, wherein a content of the zinc dithiophosphate (C) is 1 to 1000 parts by mass with respect to a total content of the ester compound (A) and the ester compound (B) being 100 parts by mass.

3. A lubricating oil composition, comprising:

70 to 99.99 mass% of a lubricant base oil; and 0.01 to 30 mass% of the lubricant additive according to claim 1.

4. A lubricating oil composition, comprising:

70 to 99.99 mass% of a lubricant base oil; and 0.01 to 30 mass% of the lubricant additive composition according to claim 2.

* * * * *